US006046658A

United States Patent [19]

Tatomir et al.

[11] Patent Number: 6,046,658

[45] Date of Patent: Apr. 4, 2000

[54] MICROWAVE FILTER HAVING CASCADED SUBFILTERS WITH PRESET ELECTRICAL RESPONSES

[75] Inventors: Paul J. Tatomir, Laguna Niguel; Keith N. Loi, Rosemead; Louis W. Hendrick, Hermosa Beach, all of Calif.

[73] Assignee: Hughes Electronics Corporation, El Segundo, Calif.

[21] Appl. No.: 09/153,121

[22] Filed: Sep. 15, 1998

[51] Int. Cl.[7] ..... H01P 1/208

[52] U.S. Cl. ..... 333/208; 333/209; 333/212

[58] Field of Search ..... 333/208, 1, 212, 333/134

[56] References Cited

U.S. PATENT DOCUMENTS

| | | | |
|---|---|---|---|
| 3,697,898 | 10/1972 | Blachier et al. | 333/209 |
| 4,246,555 | 1/1981 | Williams | 333/209 |
| 4,291,288 | 9/1981 | Young et al. | 333/212 |
| 4,360,793 | 11/1982 | Rhodes et al. | 333/212 |
| 4,477,785 | 10/1984 | Atia | 333/202 |
| 4,890,078 | 12/1989 | Radcliffe | 333/134 |
| 5,220,300 | 6/1993 | Snyder | 333/210 |
| 5,608,363 | 3/1997 | Cameron et al. | 333/202 |

FOREIGN PATENT DOCUMENTS

| | | | |
|---|---|---|---|
| 2285729 | 4/1976 | France | 333/212 |
| 22 69704 | 2/1994 | United Kingdom | 333/212 |

*Primary Examiner*—Justin P. Bettendorf
*Attorney, Agent, or Firm*—Terje Gudmestad; M. W. Sales

[57] ABSTRACT

A microwave filter has first and second subfilters. Each subfilter has at least one single mode resonator and a preset electrical response. The second subfilter is cascaded to the first subfilter by coupling one of the at least one single mode resonator of the first subfilter to one of the at least one single mode resonator of the second subfilter. The microwave filter has an overall transfer function dependent upon the selection of the first and second subfilters from a plurality of subfilters having different preset electrical responses.

13 Claims, 1 Drawing Sheet

CAMONICAL FORM OF A 2n CAVITY FILTER.
"SERIES" COUPLINGS $M_{12}$, $M_{23}$, •••• $M_{n,n+1}$ ALL HAVE SAME SIGN (POSITIVE);
"SHUNT" COUPLINGS $M_{1,2n}$, $M_{2,2n-1}$, •••• $M_{n-1,n+2}$ MUST BE EITHER POSISTIVE OR NEGATIVE FOR ARBITRARY REALIZATION.

MICROWAVE FILTER HAVING CASCADED SUBFILTERS WITH PRESET ELECTRICAL RESPONSES

TECHNICAL FIELD

The present invention relates generally to microwave cavity resonators and, more particularly, to a microwave filter having single mode resonators arranged in lower order subfilters with preset response characteristics cascaded to realize a higher order overall filter transfer function.

BACKGROUND ART

A microwave filter is a two-port network used to control the frequency response at a certain point in a microwave system by providing transmission at frequencies within the passband of the filter, and attenuation in the stopband of the filter. Typical frequency responses include low-pass, high-pass, bandpass, and band-reject characteristics.

Multi-cavity resonator microwave filters are used in communication satellites, particularly those launched into geosynchronous orbit for communications with ground stations. A plurality of filters are used in a typical satellite, each filter able to separate and isolate a specific signal or frequency bandwidth from all of the signals and frequencies transmitted to the satellite. After separation, each signal is amplified to strengthen the signal, whereafter, the amplified signals are transmitted back to ground stations. A single satellite may be equipped with twenty to sixty filters, depending on its mission.

Cavity resonator filters are hollow structures sized to resonate at specific frequency bandwidths in response to microwave signals communicated to the filter structures. The filter resonates using a specific mode dependent upon the geometry of the cavity. Filters which resonate using one mode only are referred to as single mode filters. Dielectric resonators have been introduced into cavity resonator structures, in part to improve output response and reduce the size of the cavity. Cavities with dielectric resonators are often referred to in the art as "loaded" cavities.

One such cavity filter is described in U.S. Pat. No. 5,220,300 issued to Snyder wherein a series of linearly arranged cavities are each loaded with a dielectric resonator. The wall formed between each pair of adjacent cavities is provided with a sized iris (or opening). Each iris provides a means for coupling magnetic energy between adjacent resonators. Further, a tuning screw partially extends into each iris for tuning the iris coupling.

There have also been numerous attempts at building dual mode filters, where either a cavity structure or a loaded cavity structure is designed to resonate using two modes or "dual modes". One such filter is disclosed in U.S. Pat. No. 3,697,898 issued to Blachier et al. The disclosed filter includes an elongated cylinder having planar walls therein to define a plurality of cylindrical cavities. Each cavity is coupled to adjacent cavities via a specifically sized iris formed in the wall therebetween. Dual mode cavity structures have several drawbacks.

For instance, in a communications satellite, a typical desired output from a microwave filter includes a high degree of linearity for the amplitude of the passband frequency range (the desired output) and linearity for the group delay response, in order to minimize distortion in the signal passing through the filter, while maintaining high rejection slopes flanking the filter passband. All dual or single mode filters typically require external equalization to achieve the desired performance. External equalization necessitates the use of ferrite coupling circulators, thus incurring the mass and volume penalty associated with such devices.

Dual mode filters typically require one tuning screw for each resonator to properly tune the modes and one more screw for each interresonator coupling. As readily seen, a fair amount of time is required for proper tuning of each filter in order to get the desired frequency bandwidth output. In general, dual mode filters are less amenable to transfer function control and flexibility. Lower control of the electrical characteristics means more meticulous tuning is required to make the filter meet performance requirements.

It is well known that general transfer function characteristics can be realized by a filter arranged in the canonical form structure of coupled cavity resonators as disclosed in U.S. Pat. No. 4,477,785 issued to Atia. General transfer functions include the elliptic function response for bandpass characteristics and functions having finite transmission zeros.

For an even number of cavities, this canonical form is symmetrical and consists of two identical "halves". Each of the two halves consists of n direct coupled cavities having "series" couplings of the same sign. Each cavity in one half is coupled to a corresponding cavity in the other half by "shunt" couplings of arbitrary sign. Illustrated in FIG. 1 is a schematic diagram of the canonical form of a 2n resonator filter. The series couplings $M_{12}, M_{23}, \ldots M_{n,n+1}$ all have the same sign (positive) while the shunt couplings $M_{12n}$, $M_{2,2n-1}$, $M_{n-1,n+2}$ must be either positive or negative for arbitrary transfer function realization.

In the canonical configuration, the electrical response characteristics of the filter are governed by almost every cavity. Thus, tuning the filter to achieve a desired response is not immediately obvious. What is needed is a filter having predetermined response characteristics dependent upon substructures or subfilters having preset response characteristics.

SUMMARY OF THE INVENTION

Accordingly, it is an object of the present invention to provide a microwave filter having lower order subfilters cascaded to realize a higher order overall transfer function.

It is another object of the present invention to provide a microwave filter having single mode resonators arranged and intercoupled in lower order subfilters with preset electrical responses cascaded to realize a higher order overall filter transfer function.

It is a further object of the present invention to provide a microwave filter having single mode resonators selectively arranged and intercoupled into subfilters to control individual salient features of the overall response of the filter such as transmission and delay equalization zeros.

In carrying out the above objects and other objects, the present invention provides a microwave filter including a first subfilter having at least one single mode resonator and a preset electrical response. A second subfilter having at least one single mode resonator and a preset electrical response is also provided. The second subfilter is cascaded to the first subfilter by coupling one of the at least one single mode resonator of the first subfilter to one of the at least one single mode resonator of the second subfilter. The microwave filter has an overall transfer function dependent upon the selection of the first and second subfilters from a plurality of subfilters having different preset electrical responses.

Further, in carrying out the above objects and other objects, the present invention provides a method for constructing a microwave filter having a predetermined overall transfer function. The method includes selecting a first subfilter having at least one single mode resonator and a preset electrical response from a plurality of subfilters having different preset electrical responses. A second subfilter having at least one single mode resonator and a preset electrical response is then selected from a plurality of subfilters having different preset electrical responses. The second subfilter is then cascaded to the first subfilter by coupling one of the at least one single mode resonator of the first subfilter to one of the at least one single mode resonator of the second subfilter such that the microwave filter has an overall transfer function dependent upon the selection of the first and second subfilters from the pluralities of subfilters.

The advantages accruing to the present invention are numerous. For instance, individual response characteristics are dependent mostly on known substructures. Thus, tuning the filter is greatly facilitated leading to lower overall unit cost. Another benefit of the present invention is its ability to directly control frequency response asymmetry. Current designs are not capable of controlling symmetries unless auxiliary couplings are added. This often leads to further reliability complications.

These and other features, aspects, and embodiments of the present invention will become better understood with regard to the following description, appended claims, and accompanying drawings.

BEST MODES FOR CARRYING OUT THE INVENTION

Figure 1:
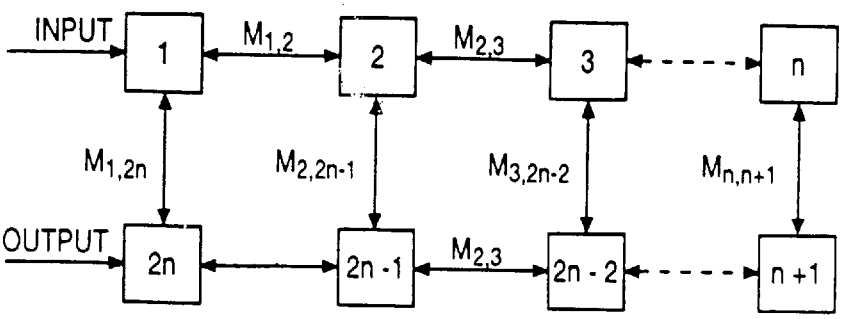
(PRIOR ART) FIG. 1
FIG. 1 is a schematic representation of the canonical form of a 2n cavity filter, also indicating couplings between the several cavities.
Figure 2:
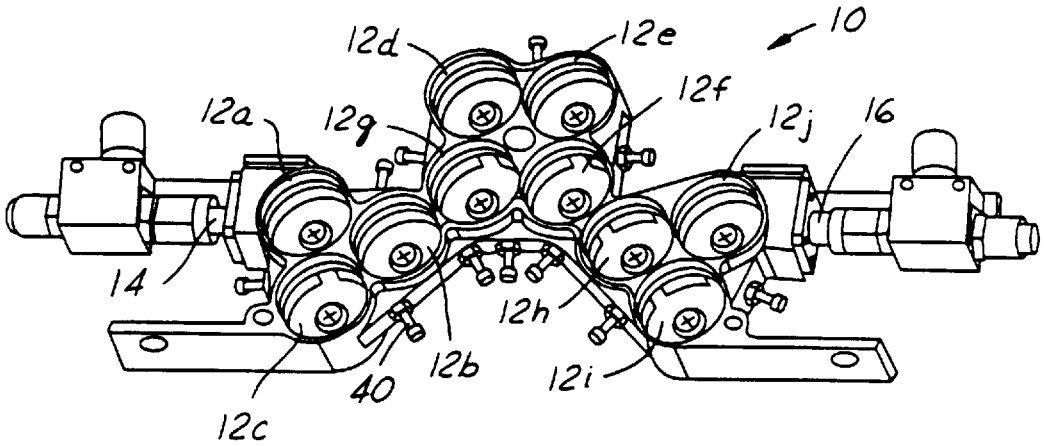
FIG. 2 is a perspective view of the microwave filter in accordance with the present invention.
Figure 3:
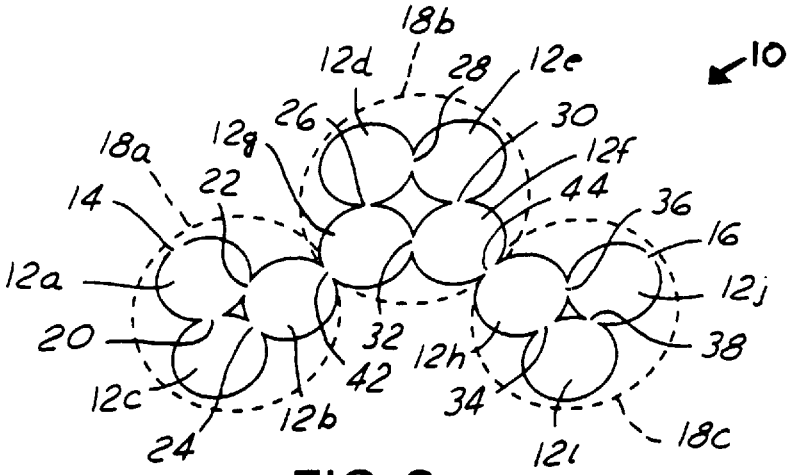
FIG. 3 is a cross-sectional view of the microwave filter showing the resonator ports and couplings in accordance with the present invention.

Referring now to FIGS. 2 and 3, a microwave filter 10 in accordance with the present invention is shown. Microwave filter 10 includes a plurality of cylindrical cavity resonators 12(*a–j*), an input port 14, and an output port 16. Resonator 12*a* is coupled to input port 14 and resonator 12*j* is coupled to output port 16. Resonators 12(*a–j*) are intercoupled such that a microwave signal travels in from input port 14 to resonator 12*a* through the other resonators 12(*b–i*) to resonator 12*j* and out of output port 16. Each of the resonators is tuned to a given resonant frequency and has a given electrical response. Tuning the resonators is accomplished by rotating an end cap to a selected axial position within the resonators (not specifically shown). Thus, microwave filter 10 filters a microwave signal input at input port 14 to produce an output microwave signal at output port 16.

Each of resonators 12(*a–j*) operates a single mode resonator. Accordingly, microwave filter 10 is of an order equal to the number of resonators. For instance, microwave filter 10 has ten resonators 12(*a–j*) and is referred to as a tenth order microwave filter.

Microwave filter 10 consists of three subfilters 18(*a–c*). Each subfilter 18(*a–c*) consists of a group of resonators. Specifically, subfilter 18*a* consists of resonators 12(*a–c*), subfilter 18*b* consists of resonators 12 (*d–g*), and subfilter 18*c* consists of resonators 12(*h–j*). Subfilters 18*a* and 18*c* are of the third order and subfilter 18*b* is of the fourth order.

The group of resonators for each subfilter 18(*a–c*) are coupled to each other by any one of a variety of means such as irises, windows, screws, polarization, and notches. In subfilter 18*a*, resonator 12*a* is coupled to resonator 12*b* by an inductive window 20 and is also coupled to resonator 12*c* by an iris 22. Resonator 12*b* is coupled to resonator 12*c* by an inductive window 24. Similarly, in subfilter 18*b*, resonators 12(*d–g*) are intercoupled by irises 26, 28, 30, and 32. In subfilter 18*c*, resonators 12(*h–j*) are intercoupled by irises 34, 36, and 38. A probe or loop such as probe 40 insertable within the irises or inductive windows may be used for tuning the coupling of the resonators.

Subfilters 18(*a–c*) are cascaded together. Subfilter 18*a* is coupled to subfilter 18*b* by an inductive window 42 between resonators 12*b* and 12*g*. Subfilter 18*b* is coupled to subfilter 18*c* by an iris 44 between resonators 12*f* and 12*h*.

Each of subfilters 18(*a–c*) have preset or known individual electrical response characteristics or transfer functions. For example, subfilter 18*a* controls the lower transmission zero, subfilter 18*b* controls the transmission group delay and phase characteristics, and subfilter 18*c* controls the upper transmission zero. The higher order overall transfer function of microwave filter 10 depends on the lower order transfer functions of each of subfilters 18(*a–c*). In essence, subfilters 18(*a–c*) control individual salient features of the overall response of microwave filter 10.

Subfilter 18*a* acts as a first filtering stage for a microwave signal input at input port 14 and produces a first stage filtered signal. The first stage filtered signal is then coupled from resonator 12*b* to resonator 12*g* for filtering by subfilter 18*b*. Subfilter 18*b* acts as a second filtering stage and produces a second stage filtered signal. The second stage filtered signal is then coupled from resonator 12*f* to resonator 12*h* for filtering by subfilter 18*c*. Subfilter 18*c* acts as a third filtering stage and produces a third stage filtered signal which is output to output port 16 from resonator 12*j*.

The third stage filtered signal is the output signal of microwave filter 10. Because the output signal depends on the filtering done at each subfilter stage, replacing a subfilter with another subfilter having a different transfer function causes the output signal to also change. Accordingly, by knowing the preset transfer function of a subfilter and then cascading that subfilter with other subfilters having preset transfer functions, the overall transfer function of microwave signal 10 and the output signal can be predicted.

Subfilters can be selected from a group of subfilters having preset electrical responses to obtain a microwave filter having a predetermined overall transfer function. Specifically, the preset electrical responses needed to obtain the predetermined overall transfer function are initially selected. The subfilters having the needed preset electrical responses are then fabricated into a one piece metal structure preferably made of aluminum. The subfilters are cascaded together such that the effects of preset electrical responses add and cancel together to form the predetermined overall transfer function of the microwave filter.

Because the individual response characteristics are dependent mostly on subfilters having preset electrical responses, tuning of microwave filter 10 is greatly facilitated. In contrast, in prior art filters employing single mode resonators laid out in the canonical configuration, the overall transfer function of the filter is governed by every resonator. Thus, optimization of the prior art filter based on a given characteristic is not immediately obvious. This leads to higher overall unit cost because the tuning of the prior art filter is time consuming.

Microwave filter 10 is a tenth order filter illustrating an example in accordance with the present invention. Filters of other orders are also possible by cascading either more third, fourth, or other order subfilters. For example, a twelfth order filter can be formed with four third order subfilters or two third order subfilters and one six order subfilter. Obviously, many configurations and filter orders are possible. Various filter designs used for satellite input applications can be redesigned to selectively specialize electrical characteristics corresponding to known physical layouts.

Thus it is apparent that there has been provided, in accordance with the present invention, a microwave filter having single mode resonators arranged and intercoupled in lower order subfilters with preset electrical responses cascaded to realize a higher order overall filter transfer function that fully satisfies the objects, aims, and advantages set forth above.

While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A microwave filter comprising:

a plurality of subfilters having preset electrical responses further comprising:

a first subfilter having at least one single mode resonator and a preset electrical response; and a second subfilter having at least one single mode resonator and a preset electrical response, wherein the second subfilter is cascaded to the first subfilter by coupling one of the at least one single mode resonator of the first subfilter to one of the at least one single mode resonator of the second subfilter, the first and second subfilters defining an overall transfer function dependent upon the selection of the first and second subfilters from the plurality of subfilters having different preset electrical responses.

2. The filter of claim 1 wherein:

the at least one single mode resonators of the first and second subfilters are single mode cylindrical cavity resonators.

3. The filter of claim 2 further comprising:

an iris for coupling the at least one single mode cylindrical cavity resonators.

4. The filter of claim 3 further comprising:

a probe insertable within the iris for tuning the coupling of the iris.

5. The filter of claim 2 further comprising:

an inductive window for coupling the at least one single mode cylindrical cavity resonators.

6. The filter of claim 5 further comprising:

a probe insertable within the inductive window for tuning the coupling of the inductive window.

7. The filter of claim 2 wherein:

the first subfilter has at least two single mode cylindrical cavity resonators, wherein at least two of the at least two single mode cylindrical cavity resonators are coupled together.

8. The filter of claim 1 further comprising:

a third subfilter having at least one single mode resonator and a preset electrical response, wherein the third subfilter is cascaded to the first and second subfilters by coupling one of the at least one single mode resonator of the third subfilter to one of the at least one single mode resonator of the second subfilter.

9. For use in a satellite, a microwave filter having an order of integer N (N>3) comprising:

a plurality of subfilters having preset electrical responses further comprising:

a first subfilter having at least three intercoupled single mode cylindrical cavity resonators and a preset electrical response; and a second subfilter having at least one single mode cylindrical cavity resonator and a preset electrical response, wherein the second subfilter is cascaded to the first subfilter by coupling one of the at least three single mode resonators of the first subfilter to the at least one single mode resonators of the second subfilter, the first and second subfilters defining an overall transfer function dependent upon the selection of the first and second subfilters from the plurality of subfilters having different preset electrical responses.

10. A method for constructing a microwave filter having a predetermined overall transfer function comprising:

selecting a first subfilter having at least one single mode resonator and a preset electrical response from a plurality of subfilters having different preset electrical responses;

selecting a second subfilter having at least one single mode resonator and a preset electrical response from a plurality of subfilters having different preset electrical responses; and cascading the second subfilter to the first subfilter by coupling one of the at least one single mode resonator of the first subfilter to one of the at least one single mode resonator of the second subfilter such that the microwave filter has an overall transfer function dependent upon the selection of the first and second subfilters from the pluralities of subfilters.

11. The method of claim 10 further comprising:

selecting a third subfilter having at least one single mode resonator and a preset electrical response from a plurality of subfilters having different preset electrical responses; and cascading the third subfilter to the first and second subfilters by coupling one of the at least one single mode resonator of the third subfilter to one of the at least one single mode resonator of the second subfilter.

12. The method of claim 10 wherein:

the first and second subfilters both have at least three single mode resonators.

13. The method of claim 10 wherein:

the at least one single mode resonators of the first and second subfilters are single mode cylindrical cavity resonators.

* * * * *